US005149907A

United States Patent [19]

Thiesen

[11] Patent Number: 5,149,907

[45] Date of Patent: Sep. 22, 1992

[54] WEAPON

[75] Inventor: Stefan Thiesen, Erkrath, Fed. Rep. of Germany

[73] Assignee: Rheinmetall GmbH, Düsseldorf, Fed. Rep. of Germany

[21] Appl. No.: 755,061

[22] Filed: Sep. 5, 1991

[30] Foreign Application Priority Data

Sep. 6, 1990 [DE] Fed. Rep. of Germany ..... 4028224

[51] Int. Cl.[5] ..... F41A 1/04

[52] U.S. Cl. ..... 89/7

[58] Field of Search ..... 89/7

[56] References Cited

U.S. PATENT DOCUMENTS

| | | | |
|---|---|---|---|
| 2,790,354 | 4/1957 | Yoler et al. | 89/8 |
| 2,965,000 | 12/1960 | Skinner | 89/7 |
| 3,690,255 | 9/1972 | Vass et al. | 89/7 |
| 3,763,739 | 10/1973 | Tassie | 89/7 |
| 4,336,741 | 6/1982 | Baines | 89/7 |
| 4,376,406 | 3/1983 | Black | 89/7 |

FOREIGN PATENT DOCUMENTS

| | | |
|---|---|---|
| 1056968 | 5/1959 | Fed. Rep. of Germany . |
| 3716078A1 | 6/1990 | Fed. Rep. of Germany . |

*Primary Examiner*—David H. Brown

*Attorney, Agent, or Firm*—Spencer, Frank & Schneider

[57] ABSTRACT

A weapon including a barrel (2), with a charge chamber (5) and an arrangement for delaying a drop in the maximum gas pressure in the barrel after firing of a charge in the chamber, with the arrangement for delaying a drop in the maximum gas pressure injecting an additional quantity of a liquid propellant (13, 13') into the charge chamber (5). To effect the injection of the liquid propellant (13, 13') into the chamber (5), primarily with a view toward short loading times, openings (10, 10', 18, 18') are provided in the barrel wall portion (9) defining the chamber (5), and these openings are connected by valves (12, 12') with containers (14, 14') containing the liquid propellant (13, 13'). The valves may be directly responsive to the maximum pressure in the chamber (5) to directly inject a measure or quantity of the liquid propellant into the charge chamber or prior to firing of a charge in the charge chamber (5) may supply the measured quantity of additional liquid propellant to a further tubular container (16, 16') connected at both ends to the charge chamber (5). In this latter case, the liquid propellant is injected via a piston (19, 19') disposed in the tubular container (16, 16') and responsive to gas pressure, and in particular gas pressure gradients in the charge chamber (5).

7 Claims, 3 Drawing Sheets

PRIOR ART

WEAPON

BACKGROUND OF THE INVENTION

The present invention relates to a weapon including a gun barrel with a charge chamber, and an arrangement for delaying the drop in the maximum gas pressure in the barrel following ignition of a charge in the chamber.

Weapons of the above general type are disclosed, for example, in DE 3,716,078 Al, DE 1,056,968 and U.S. Pat. No. 2,790,354. In order to delay a drop in the gas pressure in the barrel, these prior art publications propose to provide appropriate devices over the length of the barrel. Propellants are either ignited as soon as the projectile passes a respective ignition device, or the propellant gases are heated electrically. DE 1,056,968 also discloses the use of liquid propellants. However, no details are disclosed about the appropriate injection devices for the liquid propellants.

The drawbacks of these prior art devices are primarily the relatively complicated configuration of the tube and, in the case of solid propellants, in part the relatively long loading times.

SUMMARY OF THE INVENTION

It is therefore an object of the present invention to further develop weapons of the above mentioned type so that, on the one hand, only short loading times are required and, on the other hand, devices to prevent the drop in gas pressure can be integrated into the weapon in a simple manner. In addition, ammunition available for state of the art weapons systems employing a combustible propellant container should be usable for the weapon according to the invention.

The above object is generally achieved according to the invention by a weapon which comprises: a barrel having a wall portion defining a propellant charge chamber at a breech end of the barrel; a breech block for sealing the breech end of the barrel and the chamber; and means for delaying the drop in the maximum of the gas pressure in the barrel following ignition of a propellant charge disposed in the charge chamber, with the means for delaying being an arrangement for injecting an additional quantity of a liquid propellant into the propellant charge chamber including at least one opening in the wall portion, a reservoir for a liquid propellant, conduit means connecting the reservoir to the propellant charge chamber via the at least one opening, and means, responsive to the gas pressure in the propellant charge chamber and including a valve disposed in the conduit means, for causing injection of liquid propellant into the propellant chamber such that the gas pressure curve in the gun barrel is broadened in its maximum region without increasing the maximum pressure value.

According to one embodiment of the invention, the means for causing liquid propellant injection comprises the valve which is tuned to the gas pressure curve and opens in response to a given gas pressure in the propellant charge chamber to supply a measured quantity of liquid propellant to the propellant charge chamber, with the given gas pressure preferably being the maximum gas pressure.

Thus, this embodiment of the present invention is essentially based on the concept of injecting the liquid propellant required for the booster drive into the charge chamber at the moment of the pressure maximum and thus to realize the desired increase in performance for the fired ammunition.

According to another embodiment of the invention, the least one opening is disposed at a front portion of the propellant charge chamber; a further opening is provided in the wall portion adjacent the breech block; the conduit means includes a first portion connected between the at least one opening and the further opening and defining a tubular container, and a second portion connecting the liquid propellant reservoir to the tubular container; the valve is connected in the second portion of the conduit means to supply the additional quantity of liquid propellant from the liquid propellant reservoir to the tubular chamber prior to filing of the weapon; and the means for causing injection further includes a piston mounted in the tubular chamber for movement along the tubular chamber in response to gas pressure in the charge chamber and normally disposed at an end of the tubular chamber adjacent the further opening, and barrier means, disposed at an end of the tubular container adjacent the at least one opening and openable in response to a given pressure, for preventing the quantity of liquid propellant in the tubular container between the piston and the barrier burning means from entering the propellant charge chamber prior to firing of a propellant charge in the propellant charge chamber.

This latter embodiment is essentially based on the idea of utilizing the gas pressure gradients existing in the charge chamber during firing for injecting the liquid propellant.

Preferably, in both embodiments, the liquid propellant is a diergole propellant and a pair of injecting arrangements are provided, with one of the arrangements providing a liquid fuel and the other providing a liquid oxidizer for the fuel.

Further details and advantages will be described below with reference to embodiments of the invention that are illustrated in the drawing figures.

DETAILED DESCRIPTION OF THE PREFERRED EMBODIMENTS

Figure 1:
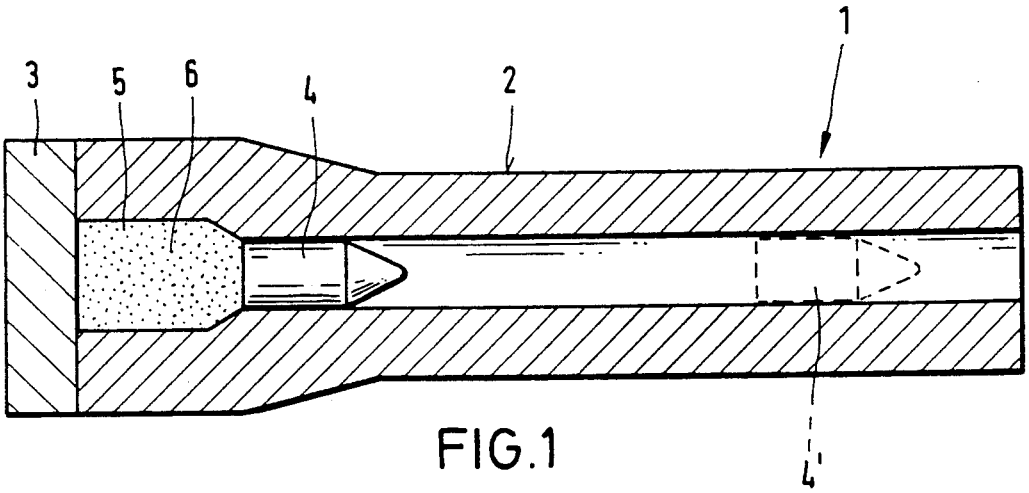
FIG. 1 is a schematic sectional illustration of a prior art weapon.

FIG. 1 is a schematic illustration of a conventional weapon 1 including a barrel 2 having a propellant charge chamber 5 at its breech end and a breech block 3 for sealing the breech end of the barrel 2 and of the chamber 5. A projectile 4 is located in the barrel 2 and a propellant charge 6 for the projectile 4 is located in chamber 5.

After ignition of propellant charge 6 in a conventional manner, projectile 4 moves along the barrel 2 via position 4' to the muzzle end of the barrel 2. During such movement the gas pressure curve marked 7 in FIG. 2 is usually obtained.

Figure 2:
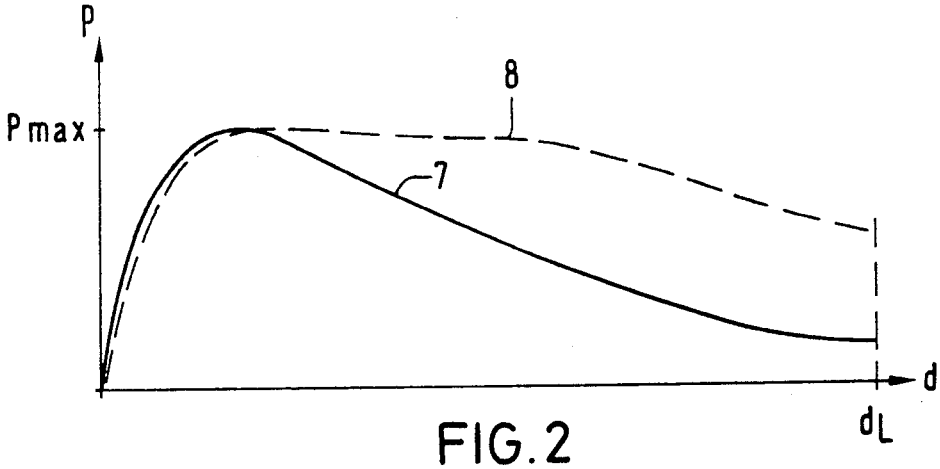
FIG. 2 shows the gas pressure curves of conventional and enhanced performance weapons.

In order to increase the muzzle velocity of projectile 4, it is now known, for example from the above-mentioned references, to extend the pressure maximum, for example, by electrically heating the propellant gases at predetermined locations along barrel 2, resulting in a curve which approximately corresponds to curve 8 of FIG. 2.

Figure 3:
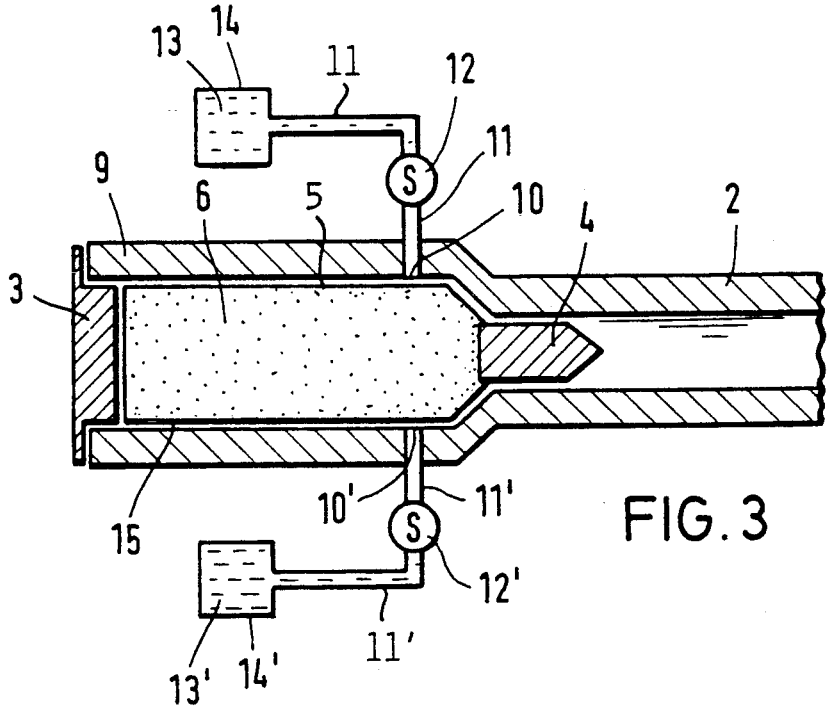
FIG. 3 is a schematic sectional view of a first embodiment of a weapon according to the invention.
Figure 4:
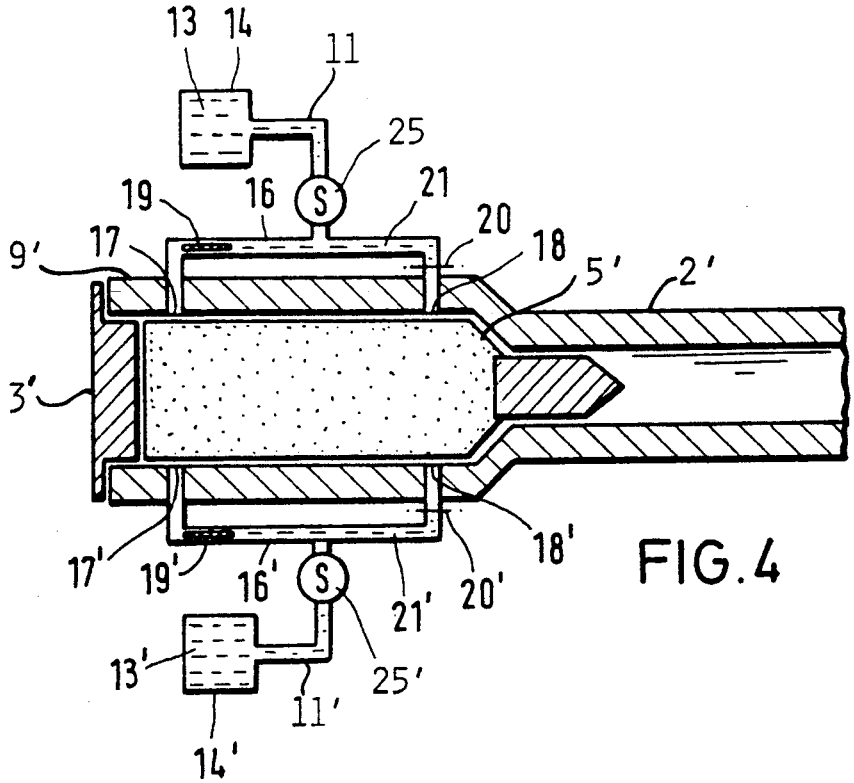
FIG. 4 is a schematic sectional view of a second embodiment of a weapon according to the invention.

To realize this pressure curve 8 in a particularly simple manner, the present invention proposes the additional injection of a liquid propellant into chamber 5 as soon as the gas pressure in the barrel 2 has approximately reached its maximum. Such devices are shown in FIGS. 3 and 4, with diergole propellants being employed. That is, the fuel and the oxidizer are supplied separately to the chamber 5. Of course, monergole propellants can also be employed for the booster drive, i.e., the additional injection of liquid propellant. In this case, fluid containers, etc. are not required.

FIG. 3 again shows the barrel 2 of the weapon, the breech block 3, a projectile 4 in the bore of barrel 2 and the propellant charge 6 disposed in the propellant charge chamber 5. Openings 10, 10' are dispose-d in the barrel wall portion 9 defining the propellant charge chamber 5 near the front end of the chamber 5, and are connected by respective conduits 11, 11' and respective valves 12, 12' with respective containers 14, 14' in which the respective liquid propellant components (fuel and oxidizer) 13, 13' are disposed. Valves 12, 12' are designed and controlled such that supplying of liquid propellant 13, 13' to the chamber 5 begins at a certain gas pressure in chamber 5. This gas pressure will generally correspond to the maximum gas pressure generated by the ammunition of propellant charge 6. The quantity of liquid propellant 13, 13' supplied by the valves 12, 12' is measured such that the gas pressure curve maximum in the barrel 2 becomes broader, i.e., extends for a longer period of time, without exceeding the maximum gas pressure produced by the introduced ammunition, i.e., the gas pressure normally produced by the charge 6.

Figure 5:
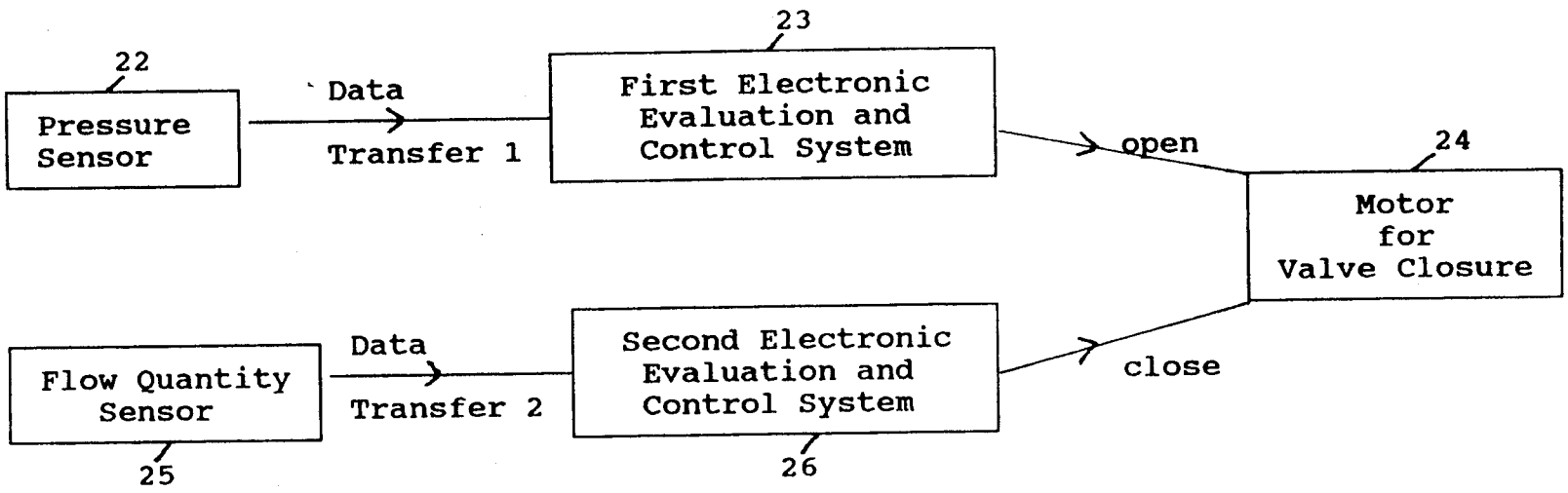
FIG. 5 is a block circuit diagram for an embodiment of valve 12.

One embodiment of valve 12 is shown in FIG. 5.

A pressure sensor 22 attached at a suitable location of the gas chamber issues, by way of a first electronic evaluation and control system 23, the instruction to open the valve to a motor 24 at a defined point in time of the gas pressure curve 7 (FIG. 2). The quantity of liquid fuel then flowing in is measured by a flow quantity sensor 25. The instruction to close the valve is given to motor 24 by a second electronic evaluation and control system 26 when the predetermined liquid fuel flow quantity value has been reached.

Instead of the above described intelligent valve type control, a valve control as shown in FIG. 4 may also be employed. According to the embodiment of FIG. 4, the required quantity of liquid propellant 13, 13' is obtained before firing of the charge 6 from respective containers 14, 14' through respective valves 25, 25' and put into respective tubular containers 16, 16' after which the valves 25, 25' are closed. Containers 16, 16' are primarily respective tubular conduits whose ends are in communication with the interior of the gun-barrel 2, and particularly the chamber 5, at two respective locations, namely through respective openings 17, 18 and 17', 18' in the barrel wall portion 9'. The openings 17, 17' are disposed in the region of the impact bottom of the charge casing for propellant charge 6, i.e. at the breech end of the chamber 5 adjacent the breech block 3,; while the other openings 18, 18' lie far front in the chamber 5; or possibly even in the caliber portion of the barrel 2; (not shown). In the vicinity of the respective front opening 18, 18', each tubular chamber 16, 16' is provided with a respective normally closed barrier device 20, 20' (only schematically indicated). These barriers 20, 20' are designed so that they open in response to a certain pressure during firing. A respective piston 19, 19' is disposed in the interior of the respective tubular containers 16, 16' for movement along the respective containers. The pistons 19, 19' are normally disposed adjacent the respective openings 17, 17' and thus normally close these openings relative to the required quantity of liquid propellant 21, 21' disposed in the respective containers 16, 16' The pistons 19, 19' and the barriers 20, 20' thus prevent the additional supply of liquid propellant 21, 21' in the containers 16, 16' from entering the chamber 5; prior to firing of the propellant charge 6.

The axial gas pressure gradients in chamber 5 between respective pairs of openings 17, 18 and 17', 18' after ignition of propellant charge 6 cause the respective pistons 19, 19' to push the additional supply of liquid propellant 21, 21' in respective tubular chambers 16, 16' through the respective openings 18, 18' into the interior of chamber 5. If this process is only incomplete, the remainder of the liquid propellant quantity 21, 21' will burn off within the respective containers 16, 16', so that the required energy is released into the chamber 5' in any case.

The barrier marked 20, 20' may, for example, be a non-illustrated, known safety disk. It is designed for the desired pressure. This bursting pressure may be generated by the gas pressure coming in through opening 18, 18' as well as by the liquid pressure coming in through opening 17, 17' and piston 19, 19'. Barrier 20, 20' is intended merely to prevent the liquid fuel from reaching the chamber prematurely.

For the propellant charge 6 initially present in chamber 5, 5' conventional propellant powder can be employed. However, propellant charge 6 must be accommodated in a combustible container. This is the case for the present high performance ammunition employed by combat tanks and in the artillery.

It will be understood that the above description of the present invention is susceptible to various modifications, changes and adaptations, and the same are intended to be comprehended within the meaning and range of equivalents of the appended claims.

What is claimed is:

1. A weapon comprising: a barrel having a wall portion defining a propellant charge chamber at a breech end of said barrel; a breech block for sealing the breech end of said barrel and said chamber; and means for delaying the drop in the maximum of the gas pressure in said barrel following ignition of a propellant charge disposed in said charge chamber, said means for delaying being an arrangement for injecting an additional quantity of a liquid propellant into said propellant charge chamber including at least one opening in said wall portion, a reservoir for a liquid propellant, conduit means connecting said reservoir to said propellant charge chamber via said at least one opening, and means responsive to the gas pressure in said propellant charge chamber and including a valve disposed in said conduit means, for causing injection of liquid propellant into said propellant chamber such that the gas pressure curve in said gun barrel is broadened in its maximum region without increasing the maximum pressure value.

2. A weapon as defined in claim 1 wherein said liquid propellant is a diergole propellant; and wherein a pair of said arrangements are provided with one of said arrangements providing a liquid fuel and the other providing a liquid oxidizer for the fuel.

3. A weapon as defined in claim 1 wherein said means for causing liquid propellant injection comprises said valve which is tuned to the gas pressure curve and opens in response to a given gas pressure in said propellant charge chamber to supply a measured quantity of liquid propellant to said propellant charge chamber.

4. A weapon as defined in claim 1 wherein said means for causing liquid propellant injection comprises said valve which is tuned to the gas pressure curve and opens in response to a maximum pressure in said propellant charge chamber to supply a measured quantity of liquid propellant to said propellant charge chamber.

5. A weapon as defined in claim 1 wherein said at least one opening is disposed at a front portion of said propellant charge chamber.

6. A weapon as defined in claim 5 wherein:

a further opening is provided in said wall portion adjacent said breech block; said conduit means includes a first portion connected between said at least one opening and said further opening and defining a tubular container and a second portion connecting said liquid propellant reservoir to said tubular container; said valve is connected in said second portion of said conduit means to supply said additional quantity of said liquid propellant from said liquid propellant reservoir to said tubular container prior to firing of said weapon; and said means for causing injection further includes a piston mounted in said tubular container for movement along said tubular container in response to gas pressure in said charge chamber and normally disposed at an end of said tubular container adjacent said further opening, and barrier means, disposed at an end of said tubular container adjacent said at least one opening and openable in response to a given pressure, for preventing the quantity of liquid propellant in said tubular container between said piston and said barrier means from entering said propellant charge chamber prior to firing of a propellant charge in said propellant charge chamber.

7. A weapon including a barrel having a wall portion defining a propellant charge chamber at a breech end of said barrel, a breech block for sealing a breech end of said chamber, and means for delaying the drop in the maximum pressure in said barrel following firing of a propellant charge disposed in said charge chamber, said means for delaying comprising: first and second openings extending through said wall portion and in communication with said charge chamber, with said first opening being disposed adjacent said breech end and said second opening being disposed adjacent a forward end of said charge chamber; a tubular chamber connected between said first and second openings; a piston disposed in said tubular chamber for movement along said tubular chamber in response to gas pressure in said charge chamber and normally disposed at an end of said tubular chamber adjacent said first opening; a source of liquid propellant; a conduit connecting said source of liquid propellant to said tubular chamber between said piston and said second opening; valve means, connected in said conduit, for supplying a given quantity of liquid propellant to said tubular chamber prior to firing of a propellant charge in said charge chamber; and normally closed barrier means, mounted in said tubular chamber adjacent said second opening, for preventing liquid propellent in said tubular chamber from entering said charge chamber prior to firing of a charge in said charge chamber and for opening in response to a given pressure after firing.

* * * * *